United States Patent [19]

Distefano et al.

[11] Patent Number: 4,998,658

[45] Date of Patent: Mar. 12, 1991

[54] DRILLED UNPORTED VACUUM DRUM WITH A POROUS SLEEVE

[75] Inventors: Joseph Distefano, Hilton; Roger Haas, Fairport; Mark Nestle, Spencerport; Fred D. Kelley, Rochester, all of N.Y.

[73] Assignee: Eastman Kodak Company, Rochester, N.Y.

[21] Appl. No.: 290,208

[22] Filed: Dec. 27, 1988

[51] Int. Cl.[5] ..... B65H 20/12

[52] U.S. Cl. ..... 226/95

[58] Field of Search ..... 29/156.5 R; 226/95, 226/97, 7

[56] References Cited

U.S. PATENT DOCUMENTS

| | | | |
|---|---|---|---|
| 3,187,409 | 6/1965 | Glass | 29/148.4 |
| 3,562,883 | 2/1971 | Kobayashi | 29/124 |
| 3,630,424 | 12/1971 | Rau | 226/95 |
| 3,710,470 | 1/1973 | Krake | 29/131 |
| 3,926,701 | 12/1975 | Nishiwaki | 156/86 |
| 4,029,249 | 6/1977 | Nagel et al. | 226/95 |
| 4,050,131 | 9/1977 | Bryand | 29/121.3 |
| 4,207,998 | 6/1980 | Schmid | 226/95 |
| 4,277,010 | 7/1981 | Landskroener et al. | 226/95 |
| 4,366,025 | 12/1982 | Gordon, Jr. et al. | 29/121.1 X |
| 4,542,596 | 9/1985 | Bryand et al. | 35/115 |
| 4,641,411 | 2/1987 | Meulen | 29/424 |
| 4,705,199 | 11/1987 | Herman et al. | 226/95 |

*Primary Examiner*—Daniel P. Stodola
*Attorney, Agent, or Firm*—G. Herman Childress

[57] ABSTRACT

An unported vacuum drum has a system of closely spaced small grooves in the outer surface thereof and holes drilled in the drum provide communication between the grooves on the outer surface and a space on the interior of the drum. The interior drum can be connected to a source of vacuum for applying the vacuum through the holes to the grooves. In order to avoid defects that may occur in a web brought into contact with a drum, the outer surface of the drum is covered with a porous sleeve. The pores in the sleeve enable the vacuum to be applied from the grooves to the outer surface of the sleeve for holding the web onto the sleeve.

2 Claims, 2 Drawing Sheets

DRILLED UNPORTED VACUUM DRUM WITH A POROUS SLEEVE

BACKGROUND OF THE INVENTION

This invention relates to vacuum drums of the kind used for gripping and feeding webs of various types, particularly webs of photographic material. More particularly, the invention relates to improvements in an unported, grooved vacuum drum.

An unported vacuum drum for gripping and feeding photographic webs is known from U.S. Pat No. 3,630,424, patented Dec. 28, 1971 in the name of John A. Rau and entlited Drilled Non-Ported Vacuum Drum. The Rau patent describes two kinds of commonly used vacuum drums. One kind has drilled holes of about 0.125 to 0.1875 inches in diameter through its shell and vacuum is applied to the holes from the drum exterior as the drum rotates. The holes are relatively large so that a porting or rotary valving system is used to disconnect the vacuum system from the portion or the drum not covered by the web. The other kind of commonly used vacuum drum discussed in the Rau patent is made from porous material and uses no porting. Air is pulled through the pores of the material even in those areas not covered by the web.

The improved vacuum drums disclosed in the Rau patent are of the non-ported kind. The Rau drums comprise a system of closely spaced small grooves in the outer surface of the drum, and vacuum feed slots that connect the grooves. A pattern of holes through the drum shell communicate with the grooves through the feed slots in the outer surface of the shell. When vacuum is supplied to the interior of the drum, air will flow along the grooves and feed slots through the holes into the interior of the drum for gripping a web in contact with the drum surface. Because the holes in the unported vacuum drum of Rau are small, e.g., less than 0.060 inches in diameter, they do not require porting as with the order commonly used of vacuum drums where the drilled holes were on the order of 0.125 to 0.1875 inches in diameter.

It is also known to shrink fit a sleeve over a roller. For example, U.S. Pat. No. 4,641,411 issued Feb. 10, 1987 to Stork Screens BV discloses a thick-walled roller covered with a non-perforated chromium sleeve. A perforated stencil or sieve is pushed over the sleeve on the roller. This is acomplished by first closing the perforations of the sieve by, for example, applying a removable fluid impervious layer around the sieve. With the cylinder and sieve in a vertical orientation the sieve is pushed upon as beveled portion of the roller. Then fluid under pressure is introduced into a space in the center of the roller and related passageways to cause the closed sieve to expanded and enable it to be pushed over the roller. The pressurized fluid acts as a lubricant during this movement. After the sieve is in place, the pressurized fluid is relieved and the sieve shrinks upon the roller.

Unported vacuum drums as generally described in the Rau patent have been in commercial use for a number of years. However, in some applications such drums are not entirely satisfactory. For example, when the drums are used in manufacturing areas where the web being driven is at a high temperature, i.e., near the glass transition temperature of the web, the grooves and slots in the outer surface of such vacuum drums may produce subtle lines in the web which adversely affect the overall finished pproduct quality. Also, some web coating enviroments use pinch roller drives. Such drives can generate polar charge patterns which survive web treatment operations in sensitizing and finally adversely influence the subsequent coating operations.

SUMMARY OF THE INVENTION

It is an object of the invention to provide an unported vacuum drum for use with webs which avoids generation of subtle lines in the web even when the web is at high operating temperatures. Another object of the invention is to provide an unported vacuum drum which eliminates polar charge patterns at pinch roller drives.

The present invention relates to improvements in a unported vacuum drum for conveying a web. The drum has an outer surface, and a hollow interior that can be coupled to a vacuum source. A plurality of small grooves are in the outer surface of the drum, and plurality of holes extending between the interior and the outer surface of the drum with at least some of the holes intersecting the grooves so that vacuum can be applied through the drum interior and the holes to the grooves to urge a web against the outer surface of the drum. The improved drum of the invention has a cylindrical porous sleeve fitted over the outer surface of the drum. The porosity of the sleeve is sufficient to enable air to flow through the sleeve so that when vacuum is applied a web will be attached to the sleeve.

The invention, and its objects and advantages will become more apparent in the detailed description of the preferred embodiment presented below.

BRIEF DESCRIPTION OF THE DRAWINGS

In the detailed description of the preferred embodiment of the invention presented below, reference is made to the accompanying drawings in which.

DETAILED DESCRIPTION OF THE INVENTION

Figure 1:
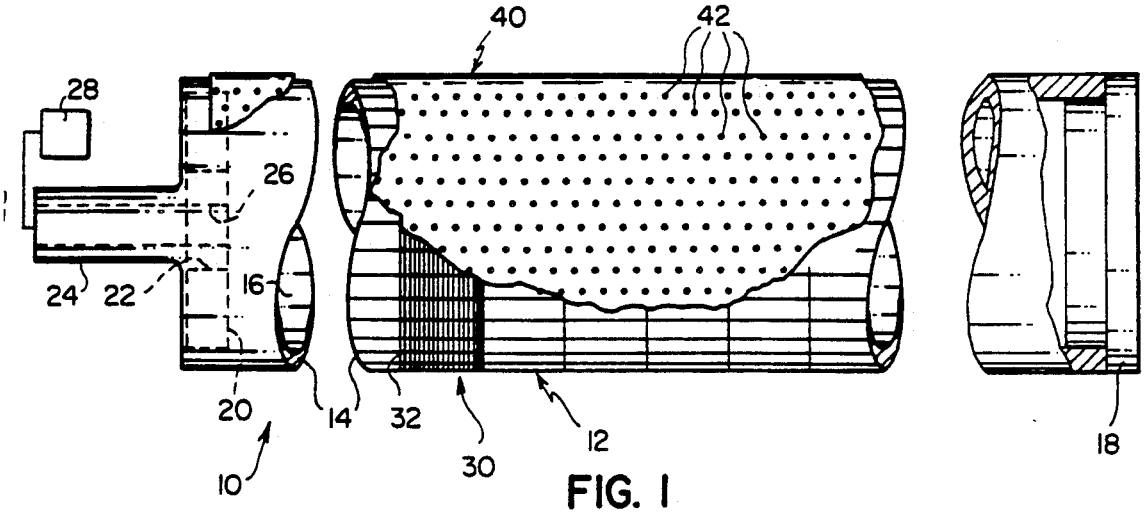
FIG. 1 is an elevation view, partially broken away, of an unported vacuum drum of the invention.

Referring now to the drawings in detail, a web conveying roller of the present invention is generally designate 10 in FIG. 1 and comprises an unported vacuum drum shown at 12. The drum 12 can be the same or similar to the drum disclosed in the beforementioned U.S. Pat. No. 3,630,424 to Rau. More specifically, the drum 12 comprises a generally cylindrical shell 14 with a hollow interior 16. Gudgeons 18 and 20 are located at the ends of the shell, and the gudgeon 18 clses the right end of the shell as viewed in FIG. 1. Gudgeon 20 has an opening 22 which receives one end of a fitting 24 that projects from the left end of the shell as viewed in FIG. 1. A passageway 26 through the fitting opens to the interior 16 of the shell and to the left end of the fitting. As shown diagrammatically FIG. 1, the fitting can be coupled to a source 28 of vacuum so that a vacuum can be applied to the interior 16 of the shell through the fitting and the gudgeon. While gudgeon 18 is shown as closing the right end of the shell, it too can be connected to a source of vacuum, if desired.

Figure 2:
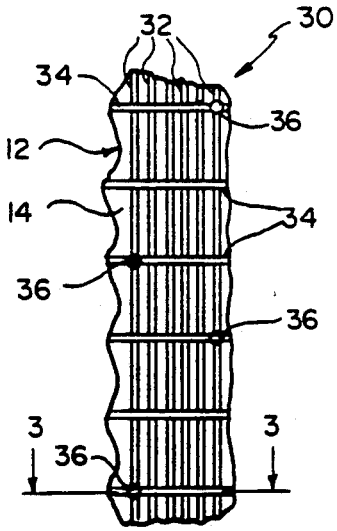
FIG. 2 is an enlarged fragmentary view of a portion of the surface of the inner drum.

The outer surface of shell 14 has a system of small grooves generally designated 30. As best shown in FIG. 2, the grooves 30 comprise a plurality of relatively closely spaced grooves 32 and a plurality of axially extending grooves 34 that are spaced apart a distance greater than the spacing in between grooves 32. Grooves 32 are parallel to each other, extend circumferentially around the shell and are equally spaced from each other along the length of the shell. Similary, grooves 34 are parallel to each other, are parallel to the axis of the shell, and are perpendicular to grooves 32.

Figure 3:
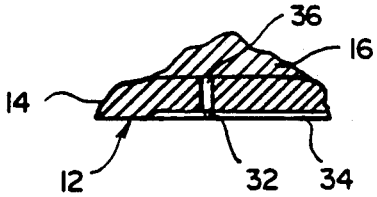
FIG. 3 is a fragmentary cross section taken along line 3—3 of FIG. 2.

The dimensions of grooves 32 and 34, and the spacing between individual grooves 32 and grooves 34 can be varied. By way of example, the grooves 32 and 34 can have a width of about 0.010 to 0.013 inches and a depth of about 0.010 to 0.013 inches. The distance between the center of two adjacent grooves 32 can be about 0.110 inches; thus there are about 9 grooves per inch. The grooves 34, on the other hand, can be located at about 10° increments around the periphery of the roller, thus providing 36 of the axially extending grooves 34. Preferably the grooves 32, 34 extend from substantially one end of the shell 14 to the other end thereof adjacent the gudgeons 18, 20. Each groove 34 can extend beyond the last grooves 32 at the ends of the shell, as indicated in FIG. 3 of the drawings.

A plurality of small holes 36 are provided through the shell 14 with each hole 36 being located at the intersection of a groove 32 and a groove 34. As shown in FIG. 2, the pattern of holes 36 may be spaced along a groove 32 at each third groove 34. In addition, holes 36 in adjacent grooves 34 can be offset by about 6 of the grooves 32. This arrangement of holes 36 enables vacuum from the interior 16 of the drum to be applied through the holes 36 and then throughout the system of grooves 32, 34. The size of holes 36 can be varied as desired. Preferably, the hole size is between 0.030 inch and 0.060 inch, and holes of about 0.043 inch have been found to work well.

Figure 4:
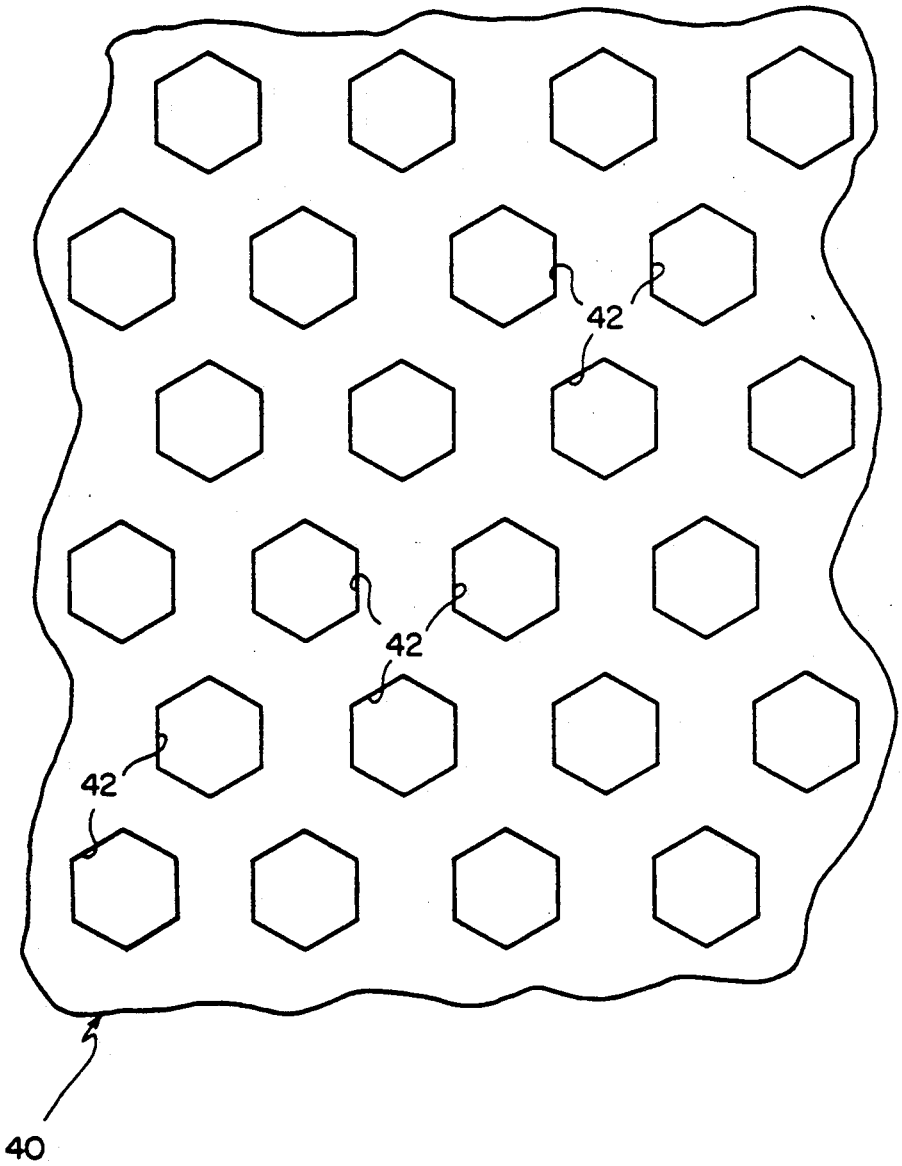
FIG.4 is an enlarged fragmentary plan view of the outer sleeve.

The aforementioned U.S. Pat No. 3,630,424 to Rau discloses a drilled, unported vacuum drum as generally described above. In accordance with the present invention drum 12 has the system of grooves 30 covered with a thin porous sleeve shown generally at 40. In a preferred embodiment of the invention sleeve 40 is porous by virtue of a multiplicity of small holes 42 arranged in a pattern which extends throughout the surface of the sleeve 40 in both radial and axial directions. While the holes 42 are shown relatively large in FIGS. 1 and 4 for the purpose of illustration, it is preferred that the holes be very small and relatively closely spaced throughout the sleeve 40. The number of holes 42 per linear inch can be varied as desired. By the way of example there can be 40–120 holes per linear inch, and preferably approximately 60–80 holes can be provided per linear inch along the surface of the sleeve. There is a pitch of 0.017 inches when 60 holes per inch are provided. While holes 42 are illustrated in FIG. 4 as being hexagonal in shape, the holes can be of any desired shape. A sleeve 40 made nickel by an electroforming process by Stork Screens B.V. of Boxmeer, Netherlands has proved satisfactory for use in the roller of the invention; however, porous sleeves of other materials manufactured by other processes also can be utilized.

Sleeve 40 is fitted over and secured to the shell 14 of the vacuum drum 12 so that the sleeve does not move relative to the shell. This can be accomplished by expanding the sleeve and slipping it over the drum then allowing it to shrink onto the drum. Apparatus for this type of assembly is disclosed in the beforementioned U.S. Pat. No. 4,641,411. When a sleeve is shrunk fit onto the shell in this manner, it can first be coated with uncurred polyvinyl alcohol, for example, and dried to render it substantially impervious. After the sleeve is expanded and shrunk fit onto the shell the polyvinyl alcohol is removed by immersing the drum in water. Sleeves having a wall thickness of about 0.005 inch and a diameter of 4–12 inches can be expanded and shrunk onto a shell in this manner.

In operation, the vacuum is provided to the interior 16 of the shell 14 from the source 28 of vacuum supply. The vacuum communicates through holes 36 with the system of grooves 30 and is distributed by the system of grooves throughout the length and circumference of the outer surface of the shell 14. The vacuum is further distributed through the multiplicity of small or tiny holes 42 in shell 40 throughout the outer surface of the shell 40 that overlaps the system of grooves 30 in the shell 14. Thus all portions of a web in contact with the sleeve 40 will be attracted to the sleeve. The sleeved unported vacuum drum as described herein is effective for both driving a web and also for supporting a web during transport between drive and take-up rolls.

The path for air flow through holes 42, the system of grooves 30 and the holes 36 into the interior 16 of the roller is a tortuous path. This, together with the fact that holes 42 are very small in size and even holes 36 are relatively small, enables vacuum to to be applied to the outer surface of sleeve 40 without the use of a vacuum of a magnitude which generates a high rate of air flow. In other words, if the air path from the exterior of sleeve 40 to the interior 16 of the drum was a relatively straight through path, such as by alignment of large holes in the shell 14 and sleeves 40, then high volume air flow rates would be required in order to hold the web to the surface of the shell. With the use of small holes and a tortuous path for air in accordance with the present invention, on the othedr hand, a continuous flow of air from the outer surface of the sleeve to the interior of the drum occurs even at low vacuum levels while still maintaining sufficient vacuum at the surface of the shell to effect driving or support of a web. The use of a low vacuum is desirable because it reduces energy consumption without reducing the tension differential for driving a web. In addition, the sleeved vacuum drum of the invention with the system of grooves 30 and the multiplicity of holes 42 in the sleeve does not require precise alignment of the sleeve relative to the shell because the multiplicity of tiny holes in the shell will always be aligned with some of grooves in the shell to enable a path of air flow from the outer surface of the shell into the interior of the drum.

The invention has been described in detail with particular reference to a preferred embodiment thereof, but it will be understood that variation and modifications can be effected within the spirit and scope of the invention.

We claim:

1. In an unported vacuum drum for conveying a web, the drum having an outer surface and a hollow interior, means for coupling the drum interior to a vacuum source, a plurality of small grooves in the outer surface of the drum, and a plurality of holes extending between the interior and the outer surface of the drum with at least some of the holes intersecting the grooves so that vacuum can be applied through the interior and the holes to the grooves to urge a web against the outer surface, the improvement comprising:

a thin cylindrical porous sleeve having an outer surface that is free of grooves over the outer surface of the drum, the porosity of the sleeve being sufficient to enable air to flow through the sleeve into the grooves in the drum so that vacuum in the grooves will attract a web to the sleeve, the porosity of the sleeve resulting from a multiplicity of very small holes substantially exceeding in number the holes in the drum, the holes being sufficiently small to avoid creating discernible marks in a web attracted to the sleeve by vacuum from the drum, the number and size of the holes in the sleeve being related to the number and size of the grooves in the drum so that holes in the sleeve are always aligned with grooves in the drum without regard to the relative positon of the drum and sleeve, whereby a tortuous path is provided for air through the holes in the sleeve, then through the grooves in the drum and into the holes in the drum when vacuum is applied through the holes in the drum.

2. Th invention as set forth in claim 1 wherein there are between 40 and 120 holes per linear inch in the sleeve, and most holes in the sleeve are not aligned with holes in the drum.

* * * * *